US008192185B2

(12) United States Patent
Wada et al.

(10) Patent No.: US 8,192,185 B2
(45) Date of Patent: Jun. 5, 2012

(54) EXPANDER-COMPRESSOR UNIT

(75) Inventors: Masanobu Wada, Osaka (JP); Yu Shiotani, Osaka (JP); Shingo Oyagi, Osaka (JP); Yasufumi Takahashi, Osaka (JP); Takeshi Ogata, Osaka (JP)

(73) Assignee: Panasonic Corporation, Osaka (JP)

( * ) Notice: Subject to any disclaimer, the term of this patent is extended or adjusted under 35 U.S.C. 154(b) by 184 days.

(21) Appl. No.: 12/743,667

(22) PCT Filed: Oct. 29, 2008

(86) PCT No.: PCT/JP2008/003092

§ 371 (c)(1),
(2), (4) Date: May 19, 2010

(87) PCT Pub. No.: WO2009/066416

PCT Pub. Date: May 28, 2009

(65) Prior Publication Data

US 2010/0269536 A1 Oct. 28, 2010

(30) Foreign Application Priority Data

Nov. 21, 2007 (JP) ..... 2007-301435

(51) Int. Cl.

| | |
|---|---|
| ***F01C 21/04*** | (2006.01) |
| ***F01C 21/06*** | (2006.01) |
| ***F03C 2/00*** | (2006.01) |
| ***F03C 4/00*** | (2006.01) |
| ***F04C 2/00*** | (2006.01) |
| ***F04C 15/00*** | (2006.01) |
| ***F04C 27/02*** | (2006.01) |
| ***F04C 29/02*** | (2006.01) |
| ***F04C 29/04*** | (2006.01) |

(52) U.S. Cl. ..... 418/88; 418/94; 417/410.5

(58) Field of Classification Search ..... 417/410.5, 417/373, 374; 418/3, 55.6, 83, 85, 88, 91, 418/94; 184/6.11, 6.21, 6.22; 62/402, 403, 62/468

See application file for complete search history.

(56) References Cited

U.S. PATENT DOCUMENTS

| | | | | | |
|---|---|---|---|---|---|
| 3,848,702 | A | * | 11/1974 | Bergman | 184/6.3 |
| 4,846,640 | A | * | 7/1989 | Nishida et al. | 418/55.6 |
| 4,865,530 | A | * | 9/1989 | Nishida et al. | 418/55.6 |
| 5,214,932 | A | * | 6/1993 | Abdelmalek | 62/238.4 |
| 5,263,822 | A | * | 11/1993 | Fujio | 418/55.4 |

(Continued)

FOREIGN PATENT DOCUMENTS

EP 1 918 510 A1 5/2008

(Continued)

*Primary Examiner* — Devon Kramer
*Assistant Examiner* — Christopher Maxey
(74) *Attorney, Agent, or Firm* — Hamre, Schumann, Mueller & Larson, P.C.

(57) ABSTRACT

An expander-compressor unit (200) includes a closed casing (1), a compression mechanism (2), an expansion mechanism (3), a shaft (5), and an oil pump (6). The shaft (5) includes an upper shaft (5*s*) provided with an upper eccentric portion (5*a*) for the compression mechanism (2), and a lower shaft (5*t*) provided with lower eccentric portions (5*d* and 5*c*) for the expansion mechanism (3) and an intermediate eccentric portion (5*e*) for the oil pump (6). The expansion mechanism (3) has an upper bearing member (45) for supporting a supported portion (5*f*) of the lower shaft (5*t*) located immediately above the lower eccentric portion (5*d*). The intermediate eccentric portion (5*e*) has a diameter equal to or less than that of the supported portion (5*f*).

11 Claims, 7 Drawing Sheets

U.S. PATENT DOCUMENTS

| | | | | |
|---|---|---|---|---|
| 5,358,392 | A * | 10/1994 | Ukai | 418/55.6 |
| 5,520,526 | A * | 5/1996 | Fujio | 418/55.4 |
| 5,616,019 | A | 4/1997 | Hattori et al. | |
| 5,660,539 | A * | 8/1997 | Matsunaga et al. | 418/55.6 |
| 5,775,883 | A * | 7/1998 | Hattori et al. | 417/310 |
| 6,098,753 | A * | 8/2000 | Lamarre et al. | 184/6.11 |
| 6,116,877 | A | 9/2000 | Takeuchi et al. | |
| 7,628,592 | B2 * | 12/2009 | Okamoto et al. | 418/3 |
| 7,717,688 | B2 * | 5/2010 | Yoo et al. | 418/88 |
| 7,771,180 | B2 * | 8/2010 | Cho et al. | 418/55.6 |
| 7,896,627 | B2 * | 3/2011 | Okamoto et al. | 418/13 |
| 8,033,135 | B2 * | 10/2011 | Okaichi et al. | 62/468 |
| 8,087,260 | B2 * | 1/2012 | Ogata et al. | 62/401 |
| 2006/0204378 | A1 * | 9/2006 | Anderson | 417/410.5 |
| 2008/0232992 | A1 | 9/2008 | Okamoto et al. | |
| 2009/0007590 | A1 * | 1/2009 | Sakitani et al. | 62/513 |
| 2009/0139262 | A1 | 6/2009 | Takahashi et al. | |
| 2009/0282845 | A1 * | 11/2009 | Hasegawa et al. | 62/87 |
| 2010/0003147 | A1 | 1/2010 | Takahashi et al. | |
| 2010/0089092 | A1 * | 4/2010 | Hasegawa et al. | 62/498 |
| 2010/0107680 | A1 * | 5/2010 | Ogata et al. | 62/468 |
| 2010/0132398 | A1 * | 6/2010 | Takahashi et al. | 62/468 |
| 2010/0162750 | A1 * | 7/2010 | Okaichi et al. | 62/498 |
| 2010/0186439 | A1 * | 7/2010 | Ogata et al. | 62/402 |
| 2010/0202909 | A1 * | 8/2010 | Shiotani et al. | 418/3 |
| 2010/0254844 | A1 | 10/2010 | Oyagi et al. | |
| 2010/0263404 | A1 | 10/2010 | Shiotani et al. | |
| 2010/0275638 | A1 * | 11/2010 | Hasegawa et al. | 62/402 |
| 2011/0138831 | A1 * | 6/2011 | Ogata et al. | 62/193 |
| 2011/0302954 | A1 * | 12/2011 | Okaichi et al. | 62/468 |

FOREIGN PATENT DOCUMENTS

| | | | | |
|---|---|---|---|---|
| EP | 1 965 022 | A1 | | 9/2008 |
| EP | 2 020 483 | A1 | | 2/2009 |
| JP | 8-028461 | A | | 1/1996 |
| JP | 8-082296 | A | | 3/1996 |
| JP | 08086289 | A | * | 4/1996 |
| JP | 9-126171 | A | | 5/1997 |
| JP | 10266980 | A | * | 10/1998 |
| JP | 2003-139059 | A | | 5/2003 |
| JP | 2005-299632 | A | | 10/2005 |
| JP | 2006132377 | A | * | 5/2006 |
| JP | 2006-283590 | A | | 10/2006 |
| JP | 2007315227 | A | * | 12/2007 |
| JP | 2008-008165 | A | | 1/2008 |
| JP | 2008-215212 | A | | 9/2008 |
| JP | 2008-240550 | A | | 10/2008 |
| WO | WO 2007/000854 | A1 | | 1/2007 |
| WO | WO 2007/132649 | A1 | | 11/2007 |
| WO | WO 2008/087795 | A1 | | 7/2008 |

* cited by examiner

EXPANDER-COMPRESSOR UNIT

TECHNICAL FIELD

The present invention relates to an expander-compressor unit including a compression mechanism for compressing a fluid and an expansion mechanism for expanding the fluid.

BACKGROUND ART

As an example of fluid machines having an expansion mechanism and a compression mechanism, an expander-compressor unit conventionally has been known. FIG. 9 is a vertical cross-sectional view of an expander-compressor unit described in JP 2005-299632 A.

An expander-compressor unit 103 includes a closed casing 120, a compression mechanism 121, a motor 122, and an expansion mechanism 123. A shaft 124 couples the motor 122, the compression mechanism 121, and the expansion mechanism 123. The expansion mechanism 123 recovers power from a working fluid (such as a refrigerant) expanding, and provides the recovered power to the shaft 124. Thereby, the power consumption of the motor 122 for driving the compression mechanism 121 is reduced, and the coefficient of performance of a system using the expander-compressor unit 103 is increased.

The closed casing 120 has a bottom portion 125 utilized as an oil reservoir. An oil pump 126 is provided at a lower end of the shaft 124 in order to pump up an oil held in the bottom portion 125 to an upper part of the closed casing 120. The oil pumped up by the oil pump 126 is supplied to the compression mechanism 121 and the expansion mechanism 123 via an oil supply passage 127 formed in the shaft 124. Thereby, lubrication and sealing are ensured in sliding parts of the compression mechanism 121 and those of the expansion mechanism 123.

An oil return passage 128 is provided at an upper part of the expansion mechanism 123. One end of the oil return passage 128 is connected to the oil supply passage 127 formed in the shaft 124, and the other end thereof opens downwardly below the expansion mechanism 123. Generally, the oil is supplied excessively for ensuring the reliability of the expansion mechanism 123. The excess oil is discharged downwardly below the expansion mechanism 123 via the oil return passage 128.

Usually, the amount of the oil contained in the working fluid is different between the compression mechanism 121 and the expansion mechanism 123. Thus, in the case where the compression mechanism 121 and the expansion mechanism 123 are accommodated in separate closed casings, a means for adjusting the amount of the oil in the two closed casings is essential in order to prevent the amount of the oil from being excess or deficient. In contrast, the expander-compressor unit 103 shown in FIG. 9 intrinsically is free from the problem of the excess or deficient oil amount because the compression mechanism 121 and the expansion mechanism 123 are accommodated in the same closed casing 120.

In the expander-compressor unit 103, the oil pumped up from the bottom portion 125 is heated by the compression mechanism 121 because the oil passes through the compression mechanism 121 having a high temperature. The oil heated by the compression mechanism 121 is heated further by the motor 122 and reaches the expansion mechanism 123. The oil that has reached the expansion mechanism 123 is cooled by the expansion mechanism 123 having a low temperature, and thereafter is discharged downwardly below the expansion mechanism 123 via the oil return passage 128. The oil discharged from the expansion mechanism 123 is heated when passing along a side face of the motor 122. The oil is heated further also when passing along a side face of the compression mechanism 121, and returns to the bottom portion 125 of the closed casing 120.

As described above, the oil circulates between the compression mechanism and the expansion mechanism so that the heat is transferred from the compression mechanism to the expansion mechanism via the oil. This heat transfer lowers the temperature of the working fluid discharged from the compression mechanism and raises the temperature of the working fluid discharged from the expansion mechanism, hindering the increase in the coefficient of performance of the system using the expander-compressor unit.

DISCLOSURE OF INVENTION

The present invention has been accomplished in view of the foregoing. The present invention is intended to suppress the heat transfer from a compression mechanism to an expansion mechanism in an expander-compressor unit.

In order to achieve the above-mentioned object, the present inventors proposed, in International Application PCT/JP2007/058871 (filing date Apr. 24, 2007, priority date May 17, 2006) preceding the present application, an expander-compressor unit including: a closed casing having a bottom portion utilized as an oil reservoir; a compression mechanism disposed in the closed casing so as to be located above or below an oil level of an oil held in the oil reservoir; an expansion mechanism disposed in the closed casing so that a positional relationship of the expansion mechanism with respect to the oil level is vertically opposite to that of the compression mechanism; a shaft coupling the compression mechanism and the expansion mechanism; and an oil pump disposed between the compression mechanism and the expansion mechanism and configured to supply the oil filling a surrounding space of the compression mechanism or the expansion mechanism to the compression mechanism or the expansion mechanism located above the oil level.

In the above-mentioned expander-compressor unit, it is conceivable that the shaft is provided with an upper eccentric portion for the compression mechanism or the expansion mechanism, an intermediate eccentric portion for the oil pump, and a lower eccentric portion for the expansion mechanism or the compression mechanism. Usually, the compression mechanism and the expansion mechanism each have a bearing member for supporting a portion of the shaft inside an eccentric portion in order to prevent the runout of the eccentric portion. Thus, in the case where the eccentric portions are provided as mentioned above, the shaft may be divided into two portions at a position above the intermediate eccentric portion, for example, from the viewpoint of inserting the shaft into the bearing member of the upper-located mechanism. The intermediate eccentric portion and the lower eccentric portion remain on the lower portion of the shaft. Therefore, as a measure to insert the lower portion of the shaft into the bearing member of the lower-located mechanism, it can be considered to allow the intermediate eccentric portion to be mounted later or further to divide the lower portion of the shaft into two portions. However, such measures increase parts count, resulting in cost increase. Hence, the present inventors have conceived a configuration that allows the lower portion of the shaft having the intermediate eccentric portion and the lower eccentric portion to be inserted into the bearing member.

More specifically, the present invention provides an expander-compressor unit including:

a closed casing having a bottom portion utilized as an oil reservoir;

a compression mechanism disposed in the closed casing so as to be located above or below an oil level of an oil held in the oil reservoir;

an expansion mechanism disposed in the closed casing so that a positional relationship of the expansion mechanism with respect to the oil level is vertically opposite to that of the compression mechanism;

an oil pump disposed between the compression mechanism and the expansion mechanism and configured to supply the oil held in the oil reservoir to one of the compression mechanism and the expansion mechanism that is located above the oil level; and a shaft coupling the compression mechanism, the oil pump, and the expansion mechanism, the shaft having an intermediate eccentric portion for the oil pump, an upper eccentric portion for the compression mechanism or the expansion mechanism located above the oil level, a lower eccentric portion for the expansion mechanism or the compression mechanism immersed in the oil held in the oil reservoir.

The shaft includes a lower shaft provided with the intermediate eccentric portion and the lower eccentric portion, and an upper shaft coupled to the lower shaft and provided with the upper eccentric portion.

The expansion mechanism or the compression mechanism immersed in the oil held in the oil reservoir has a bearing member for supporting a portion of the lower shaft above the lower eccentric portion.

The intermediate eccentric portion has a diameter equal to or less than that of the portion of the lower shaft supported by the bearing member.

Here, the phrase "the intermediate eccentric portion has a diameter equal to or less than that of the portion of the lower shaft supported by the bearing member" holds when these diameters are compared to each other as design values excluding tolerances. Even when the diameter of the intermediate eccentric portion slightly is larger than that of the portion of the lower shaft supported by the bearing member due to the tolerance, it is still regarded as "a diameter equal to or less than that of the portion of the lower shaft supported by the bearing member" as long as its design value is the same as that of the diameter of the portion of the lower shaft supported by the bearing member.

In the above-mentioned configuration, the oil pump is disposed between the compression mechanism and the expansion mechanism, and thus the oil drawn into the oil pump is supplied to the upper-located mechanism without passing through the lower-located mechanism. As a result, the heat transfer from the compression mechanism to the expansion mechanism via the oil is suppressed.

Furthermore, since the diameter of the intermediate eccentric portion of the lower shaft is equal to or less than that of the portion of the lower shaft supported by the bearing member in the configuration of the present invention, the lower shaft can be inserted into the bearing member as is even when holding the intermediate eccentric portion. Thereby, it is possible to provide the lower shaft with the intermediate eccentric portion and the lower eccentric portion integrally. Moreover, there is no need to divide the lower shaft. As a result, it is possible to prevent an increase in the parts count and suppress the cost.

BEST MODE FOR CARRYING OUT THE INVENTION

Hereinbelow, embodiments of the present invention will be described with reference to the accompanying drawings.

Figure 1:
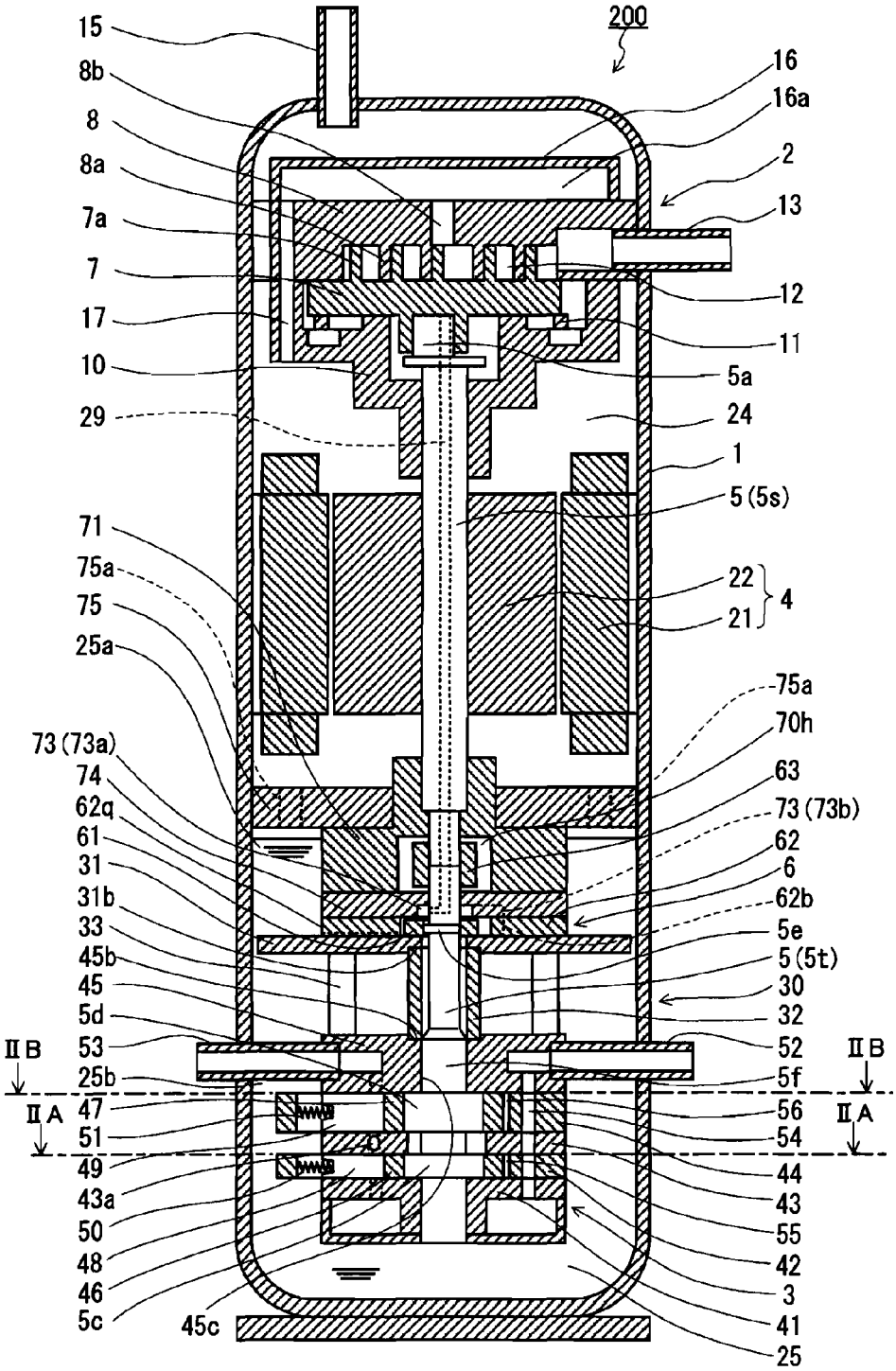
FIG. 1 is a vertical cross-sectional view of an expander-compressor unit according to one embodiment of the present invention.
Figure 2A:
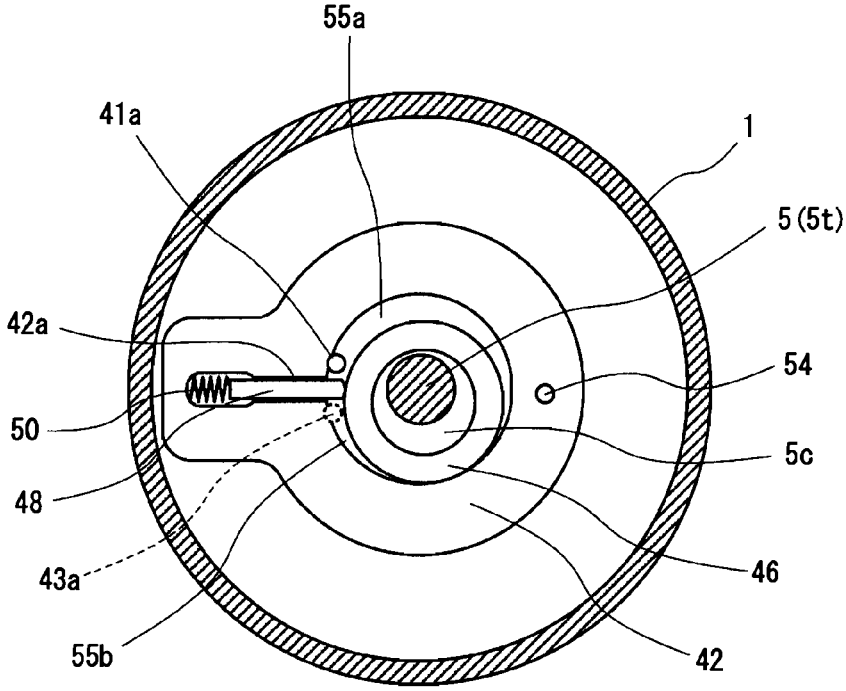
FIG. 2A is a transverse cross-sectional view of the expander-compressor unit shown in FIG. 1 taken along the line IIA-IIA.
Figure 2B:
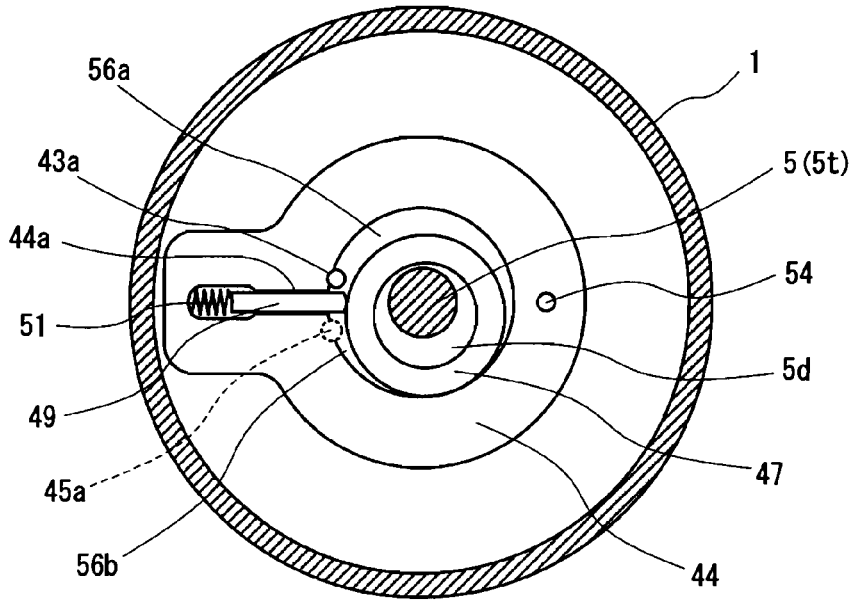
FIG. 2B is a transverse cross-sectional view taken along the line IIB-IIB in the same manner.
Figure 3:
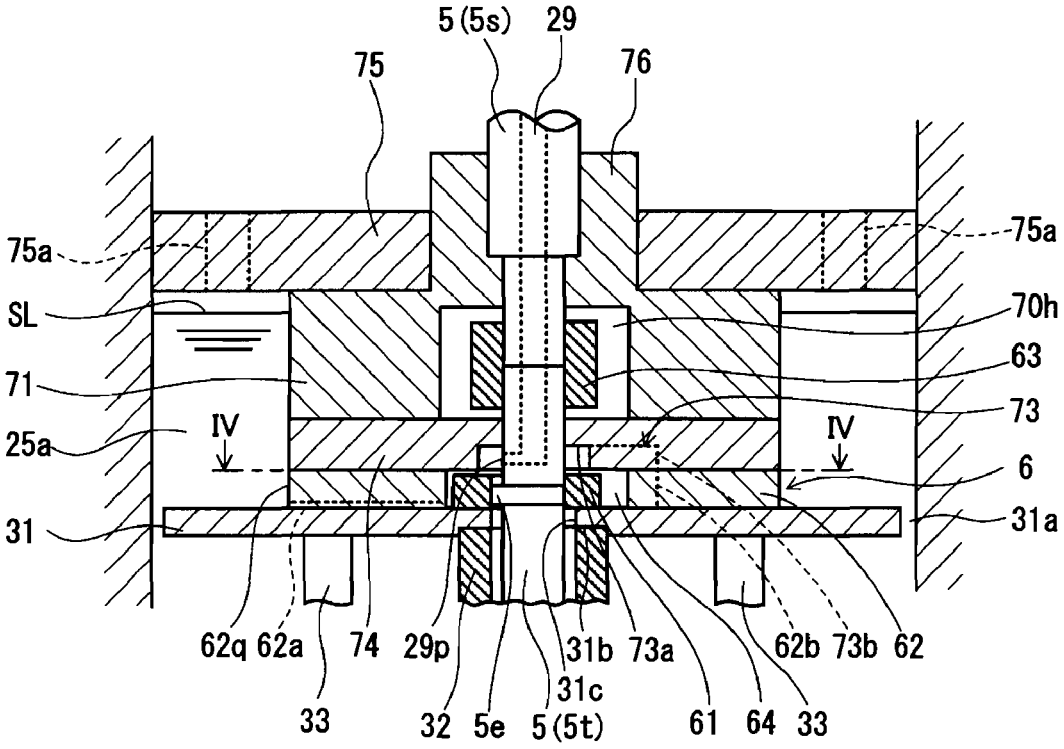
FIG. 3 is a partially enlarged view of FIG. 1.

FIG. 1 is a vertical cross-sectional view of one expander-compressor unit according to an embodiment of the present invention. FIG. 2A is a transverse cross-sectional view of the expander-compressor unit shown in FIG. 1 taken along the line IIA-IIA. FIG. 2B is a transverse cross-sectional view of the expander-compressor unit shown in FIG. 1 taken along the line IIB-IIB. FIG. 3 is a partially enlarged view of FIG. 1.

As shown in FIG. 1, an expander-compressor unit 200 includes a closed casing 1, a scroll-type compression mechanism 2 disposed at an upper position in the closed casing 1, a two-stage rotary-type expansion mechanism 3 disposed at a lower position in the closed casing 1, a motor 4 disposed between the compression mechanism 2 and the expansion mechanism 3, an oil pump 6 disposed between the motor 4 and the expansion mechanism 3, a shaft 5 coupling the compression mechanism 2, the motor 4, the oil pump 6 and the expansion mechanism 3, and a partition member 31 disposed between the expansion mechanism 3 and the oil pump 6. The motor 4 drives the shaft 5 so as to operate the compression mechanism 2. The expansion mechanism 3 recovers power from a working fluid expanding and applies it to the shaft 5 to assist the driving of the shaft 5 by the motor 4. The working fluid is, for example, a refrigerant such as carbon dioxide and hydrofluorocarbon.

In this description, an axial direction of the shaft 5 is defined as a vertical direction, a side on which the compression mechanism 2 is disposed is defined as an upper side, and a side on which the expansion mechanism 3 is disposed is defined as a lower side. Furthermore, although the scroll-type compression mechanism 2 and the rotary-type expansion mechanism 3 are employed in the present embodiment, the types of the compression mechanism 2 and the expansion mechanism 3 are not limited to these. They may be another type of positive displacement mechanism. For example, both of the compression mechanism and the expansion mechanism may be the rotary-type or the scroll-type.

As shown in FIG. 1, the closed casing 1 has a bottom portion utilized as an oil reservoir 25, and an internal space 24 above the oil reservoir is filled with the working fluid. Oil is used for ensuring lubrication and sealing of sliding parts of the compression mechanism 2 and the expansion mechanism 3. The amount of the oil held in the oil reservoir 25 is adjusted so that an oil level SL (see FIG. 3) is present above an oil suction port 62*q* of the oil pump 6 and below the motor 4 in a state where the closed casing 1 is placed upright, i.e., in a state where the posture of the closed casing 1 is determined so that the axial direction of the shaft 5 is parallel to the vertical direction. In other words, the locations of the oil pump 6 and the motor 4, and the shape and size of the closed casing 1 for accommodating these elements are determined so that the oil level of the oil is present between the oil suction port 62*q* of the oil pump 6 and the motor 4.

The oil reservoir 25 includes an upper tank 25*a* in which the oil suction port 62*q* of the oil pump 6 is located and a lower tank 25*b* in which the expansion mechanism 3 is located. The upper tank 25*a* and the lower tank 25*b* are separated from each other by the partition member 31. A surrounding space of the oil pump 6 is filled with the oil held in the upper tank 25*a*. The expansion mechanism 3 is immersed in the oil held in the lower tank 25*b*. The oil held in the upper tank 25*a* is used mainly for the compression mechanism 2, and the oil held in the lower tank 25*b* is used mainly for the expansion mechanism 3.

The oil pump 6 is disposed between the compression mechanism 2 and the expansion mechanism 3 in the axial direction of the shaft 5 so that the oil level of the oil held in the upper tank 25*a* is present above the oil suction port 62*q*. A support frame 75 is disposed between the motor 4 and the oil pump 6. The support frame 75 is fixed to the closed casing 1. The oil pump 6, the partition member 31, and the expansion mechanism 3 are fixed to the closed casing 1 via the support frame 75. A plurality of through holes 75*a* are provided in an outer peripheral portion of the support frame 75 so that the oil that lubricated the compression mechanism 2 and the oil that has been separated from the working fluid discharged to the internal space 24 of the closed casing 1 can return to the upper tank 25*a*. The number of the through hole 75*a* may be one.

The oil held in the upper tank 25*a* is drawn into the oil pump 6 and supplied to the sliding parts of the compression mechanism 2. The oil returning to the upper tank 25*a* via the through holes 75*a* of the support frame 75 after lubricating the compression mechanism 2 has a relatively high temperature because it has been heated by the compression mechanism 2 and the motor 4. The oil that has returned to the upper tank 25*a* is drawn into the oil pump 6 again. On the other hand, the oil held in the lower tank 25*b* is supplied to the sliding parts of the expansion mechanism 3. The oil that lubricated the sliding parts of the expansion mechanism 3 is returned directly to the lower tank 25*b*. The oil held in the lower tank 25*b* has a relatively low temperature because it has been cooled by the expansion mechanism 3. By disposing the oil pump 6 between the compression mechanism 2 and the expansion mechanism 3 and supplying the oil to the compression mechanism 2 by using the oil pump 6, it is possible to keep a circulation passage for the high temperature oil lubricating the compression mechanism 2 away from the expansion mechanism 3. In other words, the circulation passage for the high temperature oil lubricating the compression mechanism 2 can be separated from a circulation passage for the low temperature oil lubricating the expansion mechanism 3. Thereby, the heat transfer from the compression mechanism 2 to the expansion mechanism 3 via the oil is suppressed.

Although the effect of suppressing the heat transfer can be obtained with only the oil pump 6 disposed between the compression mechanism 2 and expansion mechanism 3, the addition of the partition member 31 can enhance this effect significantly.

When the expander-compressor unit 200 is being operated, the oil held in the oil reservoir 25 has a relatively high temperature in the upper tank 25*a* and has a relatively low temperature in a surrounding space of the expansion mechanism 3 located in the lower tank 25*b*. The partition member 31 restricts a flow of the oil between the upper tank 25*a* and the lower tank 25*b*, and thus the state in which the high temperature oil is held in the upper tank 25*a* and the low temperature oil is held in the lower tank 25*b* is maintained. Furthermore, the presence of an after-mentioned heat insulating structure 30 including the partition member 31 increases a distance between the oil pump 6 and the expansion mechanism 3 in the axial direction. This also makes it possible to reduce the amount of the heat transfer from the oil filling the surrounding space of the oil pump 6 to the expansion mechanism 3. The flow of the oil between the upper tank 25*a* and the lower tank 25*b* is restricted but not prohibited by the partition member 31. The flow of the oil from the upper tank 25*a* to the lower tank 25*b* and vice versa can occur so as to balance the oil amount.

In the present embodiment, the partition member 31 is in the shape of a disk slightly smaller than a cross section of the internal space 24 of the closed casing 1, and a slight amount of the oil is allowed to flow through a gap 31*a* (see FIG. 3) formed between an end face of the partition member 31 and an inner circumferential surface of the closed casing 1. The partition member 31 has, at a center thereof, a through hole 31*c* (see FIG. 3) for allowing the shaft 5 to extend therethrough.

The partition member 31 is not limited as long as it serves to separate the upper tank 25*a* and the lower tank 25*b* from each other and restrict the flow of the oil therebetween. The shape and configuration of the partition member 31 can be selected appropriately. For example, it also is possible that the partition member 31 has a diameter equal to an inner diameter of the closed casing 1, and the partition member 31 is provided with a through hole or a cut out from the end face for allowing the oil to flow therethrough. Alternatively, the partition member 31 may be formed into a hollow shape (for example, a reel shape) with a plurality of components so that the oil can be held therein temporarily.

A plurality (three, for example) of spacers 33 that functions as columns and a shaft cover 32 are disposed between the partition member 31 and the expansion mechanism 3. The heat insulating structure 30 is composed of the spacers 33 and the partition member 31. The spacers 33 form a space filled with the oil held in the lower tank 25*b* between the partition member 31 and the expansion mechanism 3. The oil itself filling the space ensured by the spacers 33 serves as a heat insulator and forms a thermal stratification in the axial direction.

Figure 6:
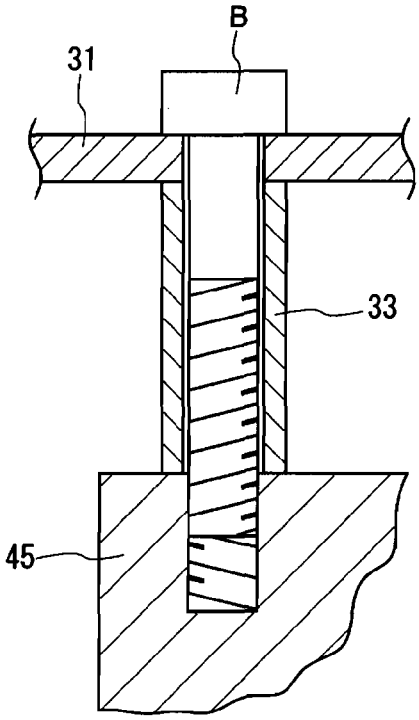
FIG. 6 is a cross-sectional view of a portion in which a spacer is disposed.

More specifically, the spacers 33 are disposed on the same circumference at equiangular intervals. As shown in FIG. 6, each of the spacers 33 is circular cylindrical, and bolt B for fixing the partition member 31 to the expansion mechanism 3 extends therethrough. Preferably, the bolt B is made of the same material as that used for the spacers 33 (iron and stainless steel, for example). This equalizes the degree of thermal expansion of the bolt B with that of the spacers 33, making it possible to prevent the distortion of the partition member 31 due to a change in temperature.

The shaft cover 32 has a circular cylindrical shape covering the shaft 5 in the space ensured by the spacers 33. The length of the shaft cover 32 is set slightly larger than that of the spacers 33. An upper fitting recess 31*b* into which an upper end portion of the shaft cover 32 can be fitted is formed in a lower face of the partition member 31. In an upper face of an after-mentioned upper bearing member 45 of the expansion mechanism 3, a lower fitting recess 45*b* into which a lower end portion of the shaft cover 32 can be fitted is formed. The shaft cover 32 is fitted into the upper fitting recess 31*b* and the lower fitting recess 45*b*, so that the shaft cover 32 is retained concentrically with the shaft 5 and a position of the partition member 31 relative to the expansion mechanism 3 is determined. More specifically, the shaft cover 32 serves also as a positioning member for determining a position of the partition member 31 relative to the expansion mechanism 3.

Next, the compression mechanism 2 and the expansion mechanism 3 will be described.

The shaft 5 has: an upper eccentric portion 5*a* for the compression mechanism 2, at an upper end portion thereof, an upper-lower pair of lower eccentric portions 5*d* and 5*c* for the expansion mechanism 3, at a position slightly above a lower end thereof, and an intermediate eccentric portion 5*e* for the oil pump 6, between the upper eccentric portion and the lower eccentric portions. More specifically, the shaft 5 is divided into two portions at a position slightly above the intermediate eccentric portion 5*e* so as to be composed of an upper shaft 5*s* provided with the upper eccentric portion 5*a* and a lower shaft 5*t* provided with the intermediate eccentric portion 5*e* and the lower eccentric portions 5*d* and 5*c*. The upper shaft 5*s* and the lower shaft 5*t* are coupled to each other with a coupler 63 so that the power recovered by the expansion mechanism 3 is transferred to the compression mechanism 2. However, it also is possible to couple the upper shaft 5*s* to the lower shaft 5*t* by fitting one of them into the other directly without using the coupler 63.

The scroll-type compression mechanism 2 includes an orbiting scroll 7, a stationary scroll 8, an Oldham ring 11, a bearing member 10, and a muffler 16. A suction pipe 13 extending from outside to inside of the closed casing 1 is connected to the stationary scroll 8. The bearing member 10 supports rotatably a portion of the upper shaft 5*s* slightly below the upper eccentric portion 5*a*. The orbiting scroll 7 is fitted with the upper eccentric portion 5*a* of the shaft 5*s*, and the self-rotation of the orbiting scroll 7 is restrained by the Oldham ring 11. The orbiting scroll 7, with a spiral shaped lap 7*a* thereof meshing with a lap 8*a* of the stationary scroll 8, scrolls in association with the rotation of the shaft 5. A crescent-shaped working chamber 12 formed between the laps 7*a* and 8*a* moves from outside to inside so as to reduce its volumetric capacity, and thereby the working fluid drawn from the suction pipe 13 is compressed. The compressed working fluid passes through a discharge port 8*b* provided at a center of the stationary scroll 8, an internal space 16*a* of the muffler 16, and a flow passage 17 penetrating through the stationary scroll 8 and the bearing member 10, in this order. The working fluid then is discharged to the internal space 24 of the closed casing 1. The oil that has reached the compression mechanism 2 via an oil supply passage 29 formed in the shaft 5 lubricates sliding surfaces between the orbiting scroll 7 and the upper eccentric portion 5*a* and sliding surfaces between the orbiting scroll 7 and the stationary scroll 8. The working fluid discharged to the internal space 24 of the closed casing 1 is separated from the oil by a gravitational force or a centrifugal force while staying in the internal space 24. Thereafter, the working fluid is discharged through a discharge pipe 15 provided at the upper part of the closed casing 1 to a gas cooler.

The motor 4 for driving the compression mechanism 2 via the shaft 5 (to be exact, the upper shaft 5*s*) includes a stator 21 fixed to the closed casing 1 and a rotor 22 fixed to the upper shaft 5*s*. Electric power is supplied from a terminal (not shown) disposed at the upper part of the closed casing 1 to the motor 4. The motor 4 may be either a synchronous machine or an induction machine. The motor 4 is cooled by the working fluid discharged from the compression mechanism 2 and the oil contained in the working fluid.

The oil supply passage 29 leading to the sliding parts of the compression mechanism 2 is formed in the shaft 5 across from the upper shaft 5*s* to the lower shaft 5*t* so as to extend in the axis direction. The lower shaft 5*t* is provided with an inlet 29*p* (see FIG. 3) for introducing the oil into the oil supply passage 29, at a position slightly above the oil pump 6. The oil discharged upward from the oil pump 6 is fed into the oil supply passage 29 via an after-mentioned introduction passage 73 and the inlet 29*p*. The oil fed into the oil supply passage 29 is supplied to each of the sliding parts of the compression mechanism 2 without passing through the expansion mechanism 3. With such a configuration, the heat transfer from the compression mechanism 2 to the expansion mechanism 3 via the oil can be suppressed effectively because the oil flowing toward the compression mechanism 2 is not cooled by the expansion mechanism 3. Moreover, the formation of the oil supply passage 29 in the shaft 5 is desirable because neither an increase in the parts count nor a problem of layout of the parts arises additionally.

The expansion mechanism 3 includes a first cylinder 42, a second cylinder 44 with a larger thickness than that of the first cylinder 42, and an intermediate plate 43 for separating the cylinders 42 and 44 from each other. The first cylinder 42 and the second cylinder 44 are disposed concentrically with each other. The expansion mechanism 3 further includes: a first piston 46 that allows the lower-side lower eccentric portion 5*c* of the lower shaft 5*t* to be fitted thereinto and performs eccentric rotational motion in the first cylinder 42; a first vane 48 that is retained reciprocably in a vane groove 42*a* (see FIG. 2A) of the first cylinder 42 and is in contact with the first piston 46 at one end; a first spring 50 that is in contact with the other end of the first vane 48 and pushes the first vane 48 toward the first piston 46; a second piston 47 that allows the upper-side lower eccentric portion 5*d* of the lower shaft 5*t* to be fitted thereinto and performs eccentric rotational motion in the second cylinder 44; a second vane 49 that is retained reciprocably in a vane groove 44*a* (see FIG. 2B) of the second cylinder 44 and is in contact with the second piston 47 at one end; and a second spring 51 that is in contact with the other end of the second vane 49 and pushes the second vane 49 toward the second piston 47. The lower-side lower eccentric portion 5*c* and the upper-side lower eccentric portion 5*d* of the lower shaft 5*t* are off-centered in the same direction as each other as shown in FIG. 2A and FIG. 2B.

The expansion mechanism 3 further includes the upper bearing member 45 and a lower bearing member 41 disposed so as to sandwich the first cylinder 42, the second cylinder 44, and the intermediate plate 43 therebetween. The upper bearing member 45 supports rotatably a portion of the lower shaft 5*t* immediately above the upper-side lower eccentric portion 5*d*. The lower bearing member 41 supports rotatably a portion of the lower shaft 5*t* immediately below the lower-side lower eccentric portion 5*c*. The upper bearing member 45 has a circular cylindrical shape extending in the vertical direction, and is provided, at a center thereof, with a shaft hole 45*c* into which the lower shaft 5*t* is fitted. The lower bearing member 41 has the shape of a saucer with a central portion protruding downward, and is provided, at a center thereof, with a shaft hole into which the lower shaft 5*t* is fitted. The intermediate plate 43 and the lower bearing member 41 sandwich the first cylinder 42 from the top and bottom, and the upper bearing member 45 and the intermediate plate 43 sandwich the second cylinder 44 from the top and bottom. Sandwiching the first cylinder 42 and the second cylinder 44 by the upper bearing member 45, the intermediate plate 43, and the lower bearing member 41 forms, in the first cylinder 42 and the second cylinder 44, working chambers whose volumetric capacities vary in accordance with the rotations of the pistons 46 and 47. Moreover, a suction pipe 52 extending from the outside to the inside of the closed casing 1 and a suction pipe 53 extending from the inside to the outside of the closed casing 1 are connected to the upper bearing member 45.

As shown in FIG. 2A, a suction-side working chamber 55*a* (first suction-side space) and a discharge-side working chamber 55*b* (first discharge-side space) are formed in the first cylinder 42. The suction-side working chamber 55*a* and the discharge-side working chamber 55*b* are demarcated by the first piston 46 and the first vane 48. As shown in FIG. 2B, a suction-side working chamber 56*a* (second suction-side space) and a discharge-side working chamber 56*b* (second discharge-side space) are formed in the second cylinder 44. The suction-side working chamber 56*a* and the discharge-side working chamber 56*b* are demarcated by the second piston 47 and the second vane 49. The total volumetric capacity of the two working chambers 56*a* and 56*b* in the second cylinder 44 is larger than the total volumetric capacity of the two working chambers 55*a* and 55*b* in the first cylinder 42. The discharge-side working chamber 55*b* in the first cylinder 42 and the suction-side working chamber 56*a* of the second cylinder 44 are connected to each other via a through hole 43*a* provided in the intermediate plate 43 so as to function as a single working chamber (expansion chamber). The working fluid having a high pressure flows from the suction pipe 52 into the working chamber 55*a* of the first cylinder 42 via a suction passage 54 penetrating through the second cylinder 44, the intermediate plate 43, the first cylinder 42 and the lower bearing member 41, and a suction port 41*a* provided in the lower bearing member 41. The working fluid that has flowed into the working chamber 55*a* of the first cylinder 42 expands and reduces its pressure in the expansion chamber composed of the working chambers 55*a* and 55*b* while rotating the shaft 5. The pressure-reduced working fluid is discharged to the discharge pipe 53 via a discharge port 45*a* provided in the upper bearing member 45.

As described above, the expansion mechanism 3 is a rotary-type mechanism including: the cylinders 42 and 44; the pistons 46 and 47 disposed in the cylinders 42 and 44 so that the lower eccentric portions 5*c* and 5*d* of the shaft 5 are fitted thereinto, respectively; and the bearing members 41 and 45 (closing members) that close the cylinders 42 and 44, respectively, and form the expansion chamber together with the cylinders 42 and 44 and the pistons 46 and 47. In a rotary-type fluid mechanism, it is necessary to lubricate a vane that partitions a space in the cylinder into two spaces due to its structural limitations. When the entire mechanism is immersed in the oil, the vane can be lubricated in a remarkably simple manner, specifically, by exposing a rear end of the vane groove in which the vane is disposed to an interior of the closed casing 1. The vanes 48 and 49 are lubricated in such a manner also in the present embodiment.

Figure 5:
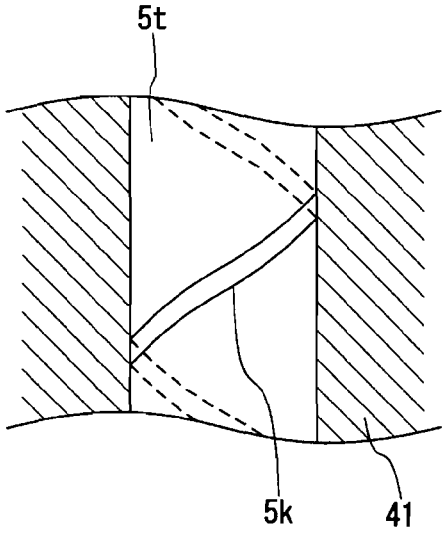
FIG. 5 is a schematic view showing an oil supply groove formed in an outer circumferential surface of a lower shaft.

The oil supply to other parts (the bearing members 41 and 45, for example) can be performed by, for example, forming a groove 5*k* in an outer circumferential surface of the lower shaft 5*t* so as to extend from a lower end of the lower shaft 5*t* toward the cylinders 42 and 44 of the expansion mechanism 3, as shown in FIG. 5. The pressure applied to the oil held in the oil reservoir 25 is higher than the pressure applied to the oil that is lubricating the cylinders 42 and 44 and the pistons 46 and 47. Thus, the oil can be supplied to the sliding parts of the expansion mechanism 3 by flowing through the groove 5*k* formed in the outer circumferential surface of the lower shaft 5*t* without the aid of the oil pump.

Next, the oil pump 6 and the configuration around it will be described in detail.

As shown in FIG. 3, the oil pump 6 is a positive displacement pump configured to pump the oil by an increase or decrease in the volumetric capacity of the working chamber as the shaft 5 rotates. An introduction member 74 and a relay member 71 are disposed in order above the oil pump 6. The shaft 5 penetrates through centers of the introduction member 74 and the relay member 71. The oil pump 6 is fixed to the support frame 75 via these members 74 and 71.

The relay member 71 has an internal space 70*h* for accommodating the coupler 63, and a bearing portion 76 for supporting the shaft 5 (the upper shaft 5*s*). In other words, the relay member 71 serves as a housing for the coupler 63 as well as a bearing for the shaft 5. The support frame 75 may have a portion equivalent to the bearing portion 76. Furthermore, the support frame 75 and the relay member 71 may be formed of a single component.

The introduction member 74 has the shape of a plate that is squashed in the vertical direction. The introduction member 74 is provided with the introduction passage 73 allowing a discharge port of the oil pump 6 to be communicated with the inlet 29*p* of the shaft 5. The introduction passage 73 is formed by recessing a specified region on a lower face of the introduction member 74. The introduction passage 73 includes an annular portion 73*a* that is circular and surrounds the shaft 5, and a guide portion 73*b* extending from the annular portion 73*a* to a position corresponding to the discharge port of the oil pump 6. The inlet 29*p* of the shaft 5 is provided at a portion of the shaft 5 facing the annular portion 73*a* of the introduction passage 73, and is opened laterally. The shape and direction of the introduction passage 73 do not necessarily have to be as described above, and can be selected appropriately. Moreover, the number of the inlet 29*p* does not necessarily have to be one, either. A plurality of the inlets 29*p* may be provided.

Figure 4:
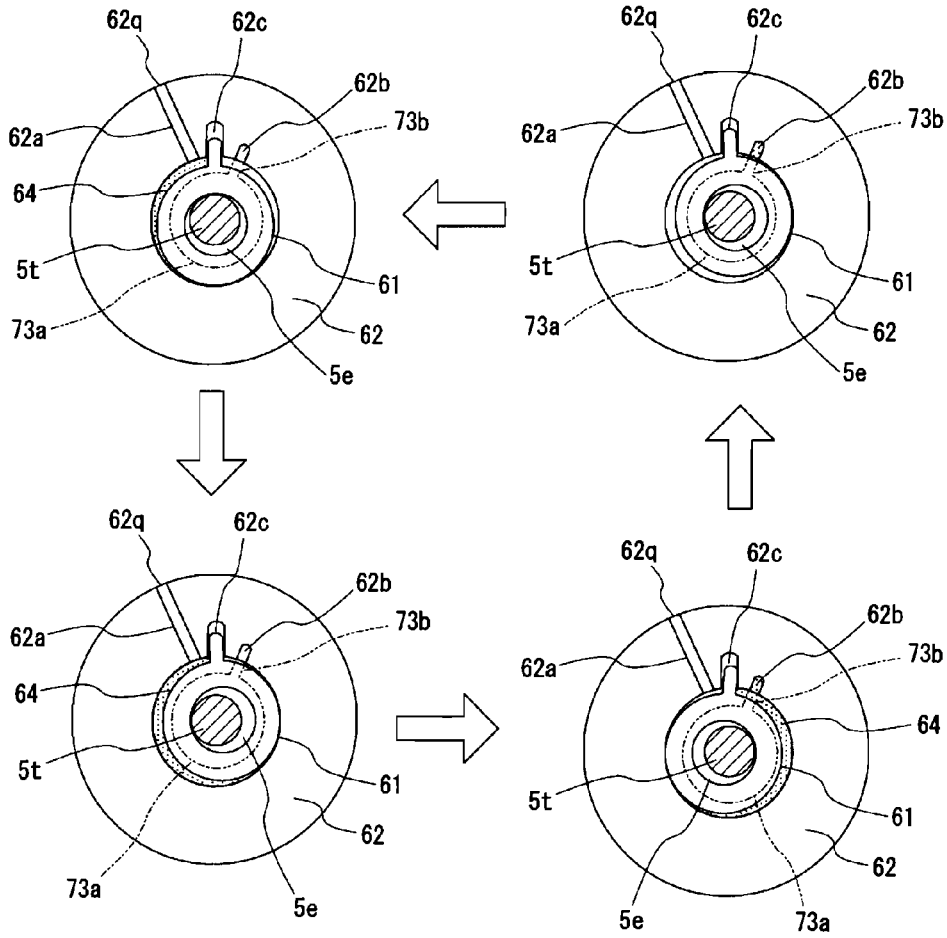
FIG. 4 is a plan view of an oil pump taken along the line IV-IV shown in FIG. 3.

FIG. 4 shows a plan view of the oil pump 6. The oil pump 6 has a piston 61 and a housing 62 (cylinder) accommodating the piston 61. The intermediate eccentric portion 5*e* of the lower shaft 5*t* is fitted into the piston 61, and the piston 61 performs eccentric motion. A crescent-shaped working chamber 64 is formed between the piston 61 and the housing 62. More specifically, the oil pump 6 employs a rotary-type fluid mechanism. As shown in FIG. 4, in the present embodiment, the oil pump 6 has a configuration in which the piston 61 cannot self-rotate. However, the oil pump 6 is not limited as long as it is a rotary-type positive displacement pump. The oil pump 6 may have a configuration in which a slide vane is provided and the piston 61 can self-rotate.

In the housing 62, there are formed a suction passage 62*a* connecting the upper tank 25*a* of the oil reservoir 25 to the working chamber 64, and a discharge passage 62*b* that allows the oil to escape from the working chamber 64. The suction passage 62*a* extends on a straight line along an upper face of the housing 62. The discharge passage 62*b* is in the shape of a groove that recesses from an inner circumferential surface of the housing 62 toward outside in a radial direction. The suction port 62*q* is formed by an outside opening of the suction passage 62*a*, and the discharge port is formed by an upper opening of the discharge passage 62*b*. A lower opening of the discharge passage 62*b* is closed by the partition member 31. When the piston 61 performs eccentric motion in the housing 62 as the lower shaft 5*t* rotates, the volumetric capacity of the working chamber 64 increases or decreases accordingly, so that the oil is drawn thereinto from the suction port 62*q* and the oil is discharged upward from the discharge port. Such a mechanism does not convert the rotational motion of the lower shaft 5*t* into another motion by a cam mechanism or the like but directly utilizes it as the motion for pumping the oil. Therefore, the mechanism has the advantage that the mechanical loss is small. Moreover, the mechanism is highly reliable because it has a relatively simple structure.

As shown in FIG. 3, the introduction member 74 is disposed adjacent to the housing 62 so that the lower face of the introduction member 74 is in contact with the upper face of the housing 62, and the partition member 31 is disposed adjacent to the housing 62 so that an upper face of the partition member 31 is in contact with a lower face of the housing 62. Thereby, the working chamber 64 is closed by the introduction member 74 from the top and is closed by the partition member 31 from the bottom. The piston 61 slides on the partition member 31. The housing 62 preferably is integrated with the partition member 31. This is because, since the position of the partition member 31 relative to the expansion mechanism 3 is determined by the shaft cover 32 as described above, the work of determining the position of the housing 62 is unnecessary when the housing 62 is integrated with the partition member 31. It also is possible to integrate the introduction member 74 with the housing 62.

Next, the lower shaft 5*t* will be described in more detail with reference to FIG. 1 and FIG. 7.

The lower shaft 5*t* has a portion (hereinafter referred to as a "supported portion") 5*f* supported by the upper bearing member 45 of the expansion mechanism 3. Above the supported portion 5*f*, the lower shaft 5*t* has a smaller diameter than diameter D1 of the supported portion 5*f*. Thus, the lower shaft 5*t* has a portion that is slimmer than the supported portion 5*f*, in a region corresponding to the spacers 33 that ensure a space between the partition member 31 and the expansion mechanism 3. Thereby, the heat transfer from the upper tank 25*a* to the lower tank 25*b* via the lower shaft 5*t* can be suppressed. The upper shaft 5*s* has a diameter approximately equal to a diameter of an upper side portion of the lower shaft 5*f*, from a lower end to a certain point in a portion supported by the relay member 71.

The intermediate eccentric portion 5*e* has diameter D2 that is equal to or less than the diameter of the supported portion 5*f*. Thereby, it is possible to insert the lower shaft 5*t* into the shaft hole 45*c* of the upper bearing member 45 of the expansion mechanism 3 from a side of the intermediate eccentric portion 5*e*. Furthermore, a diameter of the through hole 31*c* of the partition member 31 and an inner diameter of the shaft cover 32 each are equivalent to a diameter of the shaft hole 45*c* of the upper bearing member 45, so that the lower shaft 5*t* can be inserted also into the shaft cover 32 and the through hole 31*c* of the partition member 31 from the side of the intermediate eccentric portion 5*e*. Since the shaft cover 32 is fitted into the fitting recesses 31*b* and 45*b* so as to be retained concentrically with the shaft 5 (the lower shaft 5*t*), a circular cylindrical heat insulating layer filled with the oil is formed between the lower shaft 5*t* and the shaft cover 32. The heat insulating layer can suppress further the heat transfer from the upper tank 25*a* to the lower tank 25*b* via the lower shaft 5*t*.

Figure 7:
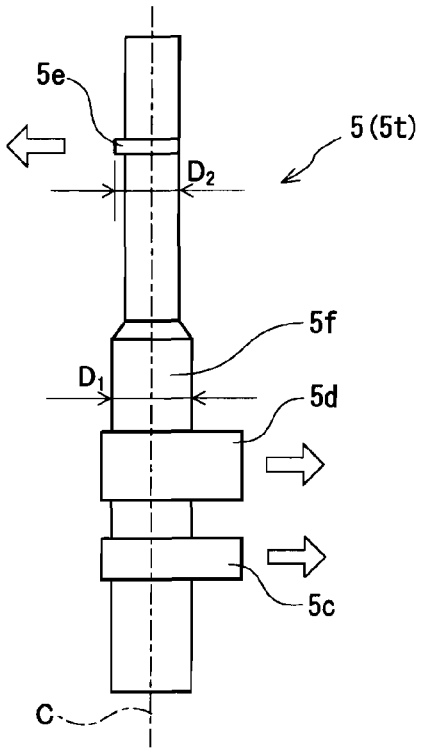
FIG. 7 is a side view of the lower shaft.

Furthermore, as shown in FIG. 7, the intermediate eccentric portion 5*e* is off-centered in a direction opposite to a direction in which the lower eccentric portions 5*d* and 5*c* are off-centered with respect to shaft center axis C of the lower shaft 5*t*. The direction in which the intermediate eccentric portion 5*e* is off-centered preferably is 180° away from the direction in which the lower eccentric portions 5*d* and 5*c* are off-centered. However, it may vary within the range of approximately ±10° from this angle.

As described above, in the expander-compressor unit 200 of the present embodiment, the diameter D2 of the intermediate eccentric portion 5*e* of the lower shaft 5*t* is equal to or less than the diameter D1 of the supported portion 5*f* supported by the upper bearing member 45 of the expansion mechanism 3. Thus, the lower shaft 5*t* can be inserted into the shaft hole 45*c* of the upper bearing member 45 as is even when holding the intermediate eccentric portion 5*e*. Thereby, it is possible to provide the lower shaft 5*t* with the intermediate eccentric portion 5*e* and the lower eccentric portions 5*d* and 5*c* integrally. Moreover, there is no need to divide the lower shaft 5*t*. As a result, it is possible to prevent an increase in the parts count and suppress the cost.

Furthermore, since the intermediate eccentric portion 5*e* is off-centered in the direction opposite to the direction in which the lower eccentric portions 5*d* and 5*c* are off-centered, the intermediate eccentric portion 5*e* serves as a balance weight, making it possible to reduce the influence of the centrifugal force that acts on the lower eccentric portions 5*d* and 5*c* when the shaft rotates.

In the above-mentioned embodiment, the compression mechanism 2 is disposed on an upper side and the expansion mechanism 3 is disposed on a lower side. However, the positions of the compression mechanism 2 and the expansion mechanism 3 may be opposite to those in the present embodiment. More specifically, the compression mechanism 2 may be located below the oil level SL of the oil held in the oil reservoir 25, and the expansion mechanism 3 may be located above the oil level SL. In this case, the lower shaft 5*t* has the intermediate eccentric portion 5*e* for the oil pump 6 and the lower eccentric portion for the compression mechanism 2, and a portion between these eccentric portions is supported by the bearing member 10 of the compression mechanism 2. In addition, the oil held in the oil reservoir 25 is supplied to the expansion mechanism 3 located above the oil level SL by the oil pump 6.

INDUSTRIAL APPLICABILITY

Figure 8:
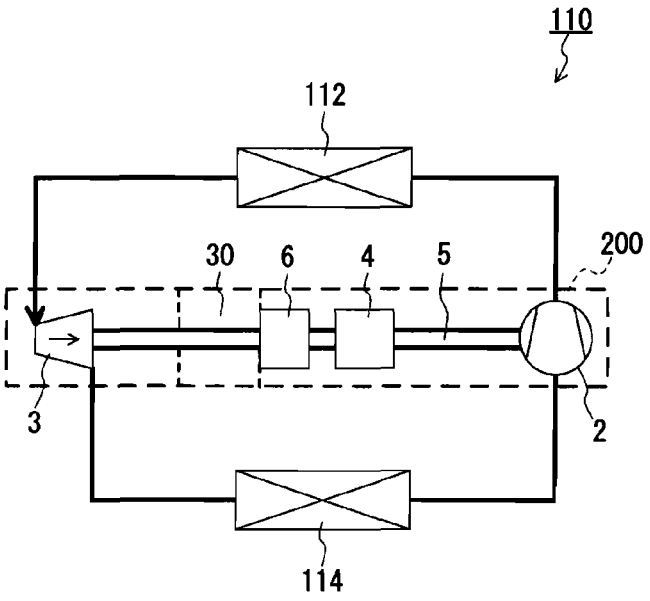
FIG. 8 is a configuration diagram of a heat pump using the expander-compressor unit.
Figure 9:
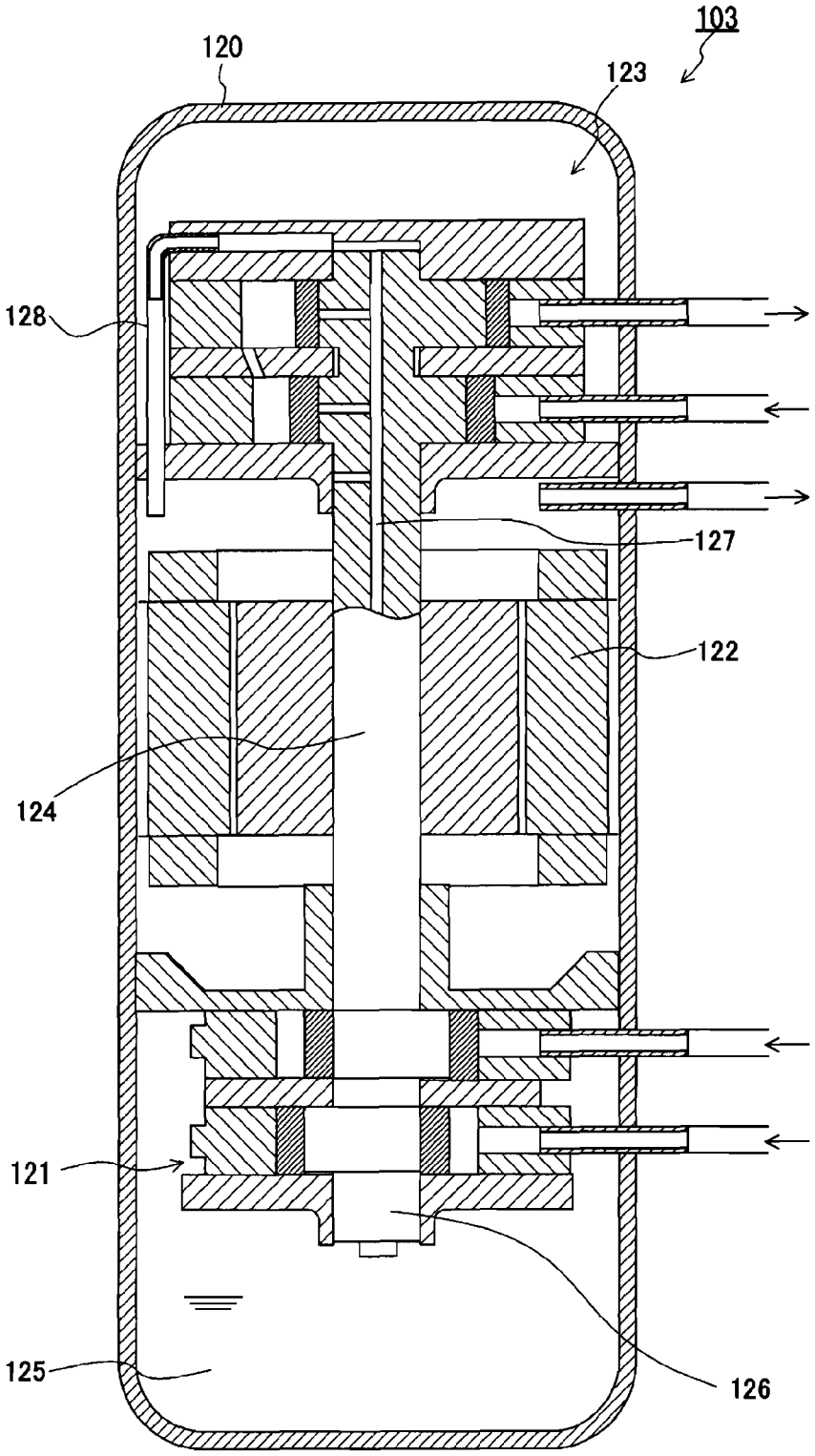
FIG. 9 is a cross-sectional view of a conventional expander-compressor unit.

The expander-compressor unit according to the present invention suitably may be applied to, for example, heat pumps for air conditioners, water heaters, driers, and refrigerator-freezers. As shown in FIG. 8, the heat pump 110 includes the expander-compressor unit 200, a radiator 112 for radiating heat from the refrigerant compressed by the compression mechanism 2, and an evaporator 114 for evaporating the refrigerant expanded by the expansion mechanism 3. The compression mechanism 2, the radiator 112, the expansion mechanism 3, and the evaporator 114 are connected with pipes so as to form a refrigerant circuit. The expander-compressor unit 200 may be replaced by an expander-compressor unit according to another embodiment.

For example, in the case where the heat pump 110 is applied to an air conditioner, suppressing the heat transfer from the compression mechanism 2 to the expansion mechanism 3 can prevent a decrease in the heating capacity due to a decrease in the discharge temperature of the compression mechanism 2 during a heating operation and prevent a decrease in the cooling capacity due to an increase in the discharge temperature of the expansion mechanism 3 during a cooling operation. As a result, the coefficient of performance of the air conditioner is increased.

The invention claimed is:

1. An expander-compressor unit comprising:

a closed casing having a bottom portion utilized as an oil reservoir;

a compression mechanism disposed in the closed casing so as to be located above or below an oil level of an oil held in the oil reservoir;

an expansion mechanism disposed in the closed casing so that a positional relationship of the expansion mechanism with respect to the oil level is vertically opposite to that of the compression mechanism;

an oil pump disposed between the compression mechanism and the expansion mechanism and configured to supply the oil held in the oil reservoir to one of the compression mechanism and the expansion mechanism that is located above the oil level; and a shaft coupling the compression mechanism, the oil pump, and the expansion mechanism, the shaft having an intermediate eccentric portion for the oil pump, an upper eccentric portion for the compression mechanism or the expansion mechanism located above the oil level, a lower eccentric portion for the expansion mechanism or the compression mechanism immersed in the oil held in the oil reservoir, wherein:

the shaft includes a lower shaft provided with the intermediate eccentric portion and the lower eccentric portion, and an upper shaft coupled to the lower shaft and provided with the upper eccentric portion;

the expansion mechanism or the compression mechanism immersed in the oil held in the oil reservoir has a bearing member for supporting a portion of the lower shaft above the lower eccentric portion; and the intermediate eccentric portion has a diameter equal to or less than that of the portion of the lower shaft supported by the bearing member.

2. The expander-compressor unit according to claim 1, further comprising a motor located between the oil pump and one of the compression mechanism and the expansion mechanism that is located above the oil level, the motor having a rotor fixed to the upper shaft.

3. The expander-compressor unit according to claim 1, wherein the intermediate eccentric portion is off-centered in a direction opposite to a direction in which the lower eccentric portion is off-centered with respect to a shaft center axis of the lower shaft.

4. The expander-compressor unit according to claim 1, wherein the compression mechanism is located above the oil level and the expansion mechanism is located below the oil level.

5. The expander-compressor unit according to claim 4, wherein the compression mechanism is a scroll-type mechanism and the expansion mechanism is a rotary-type mechanism.

6. The expander-compressor unit according to claim 4, further comprising a partition member that is disposed between the oil pump and the expansion mechanism, partitions the oil reservoir into an upper tank in which a suction port of the oil pump is located and a lower tank in which the expansion mechanism is located, and restricts a flow of the oil between the upper tank and the lower tank.

7. The expander-compressor unit according to claim 6, further comprising a spacer that is disposed between the partition member and the expansion mechanism and ensures a space between the partition member and the expansion mechanism.

8. The expander-compressor unit according to claim 7, wherein a plurality of the spacers are disposed, each of the spacers is cylindrical, a bolt for fixing the partition member to the expansion mechanism extends through each of the spacers, and the spacers are made of the same material as that used for the bolt.

9. The expander-compressor unit according to claim 7, wherein the lower shaft has, in a region corresponding to the spacer, a portion that is slimmer than the portion of the lower shaft supported by the bearing member.

10. The expander-compressor unit according to claim 7, further comprising a shaft cover covering the lower shaft in the space ensured by the spacer, wherein the shaft cover serves also as a positioning member for determining a position of the partition member relative to the expansion mechanism.

11. The expander-compressor unit according to claim 10, wherein the oil pump has a piston into which the intermediate eccentric portion is fitted and a housing accommodating the piston, and the piston housing is integrated with the partition member.

* * * * *